US006546651B2

(12) United States Patent
Tremonti

(10) Patent No.: US 6,546,651 B2
(45) Date of Patent: Apr. 15, 2003

(54) MEMORABILIA DEVICE WITH TICKET DISPLAY

(75) Inventor: Daniel Tremonti, Chicago, IL (US)

(73) Assignee: Three Mountain Group, LLC, Chicago, IL (US)

( * ) Notice: Subject to any disclaimer, the term of this patent is extended or adjusted under 35 U.S.C. 154(b) by 202 days.

(21) Appl. No.: 09/725,701

(22) Filed: Nov. 29, 2000

(65) Prior Publication Data

US 2002/0062588 A1 May 30, 2002

Related U.S. Application Data

(60) Provisional application No. 60/167,370, filed on Nov. 30, 1999.

(51) Int. Cl.[7] ..... G09E 1/00

(52) U.S. Cl. ..... 40/124.01; 40/360; 40/638; 40/773

(58) Field of Search ..... 40/124.01, 360, 40/638, 486, 492, 773, 776

(56) References Cited

U.S. PATENT DOCUMENTS 2,268,095 A * 12/1941 Tiebei ..... 40/492
2,363,472 A * 11/1944 Ritter ..... 229/92.8
2,994,298 A * 8/1961 Thomas ..... 118/500
3,002,720 A * 10/1961 Cross ..... 248/463
4,237,633 A * 12/1980 Murrell ..... 40/773
4,662,093 A * 5/1987 Suttles et al. ..... 40/773
4,681,253 A * 7/1987 Engelhardt ..... 229/92.8
4,807,807 A * 2/1989 Glick ..... 229/92.8
4,829,691 A * 5/1989 Manjos et al. ..... 40/661
5,147,043 A * 9/1992 Gould ..... 40/124.1
5,791,620 A * 8/1998 Carcich, Jr. ..... 248/346.01
6,261,378 B1 * 4/2001 Roberto ..... 40/773

* cited by examiner

*Primary Examiner*—D. Glenn Dayoan
*Assistant Examiner*—Gregory Blankenship
(74) *Attorney, Agent, or Firm*—Leydig, Voit & Mayer, Ltd.

(57) ABSTRACT

A keepsake/ticket display and memorabilia device is disclosed comprising a main card having a display window and a display card member pivotably connected to the main card. The display card member provides a flat surface upon which a ticket, ticket stub, or other generally flat keepsake can be mounted. The display card member is pivotable with respect to the main card such that it can be generally positioned under the display window of the main card, thereby displaying the ticket through the display window. Various indicia relating to a specific event for which the ticket was purchased can be printed on the main card thereby enhancing the display of the ticket.

18 Claims, 2 Drawing Sheets

FIG. 2
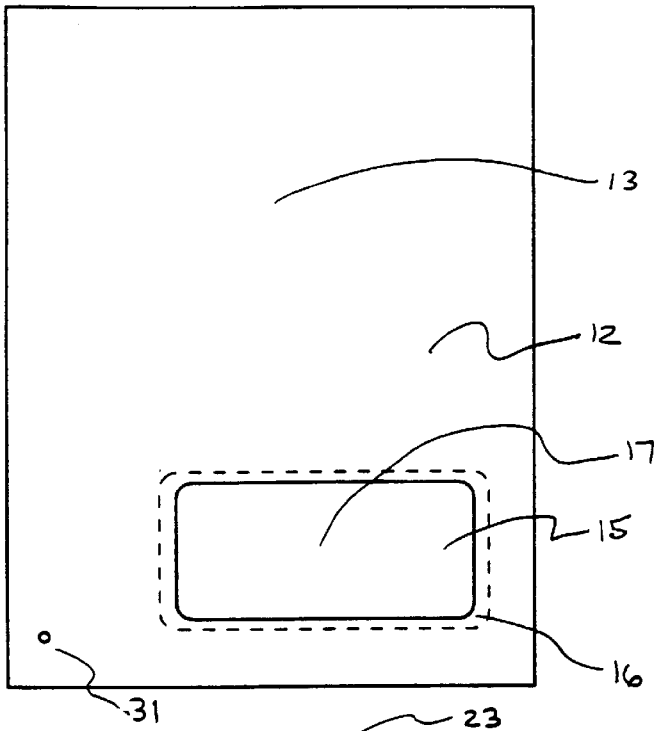
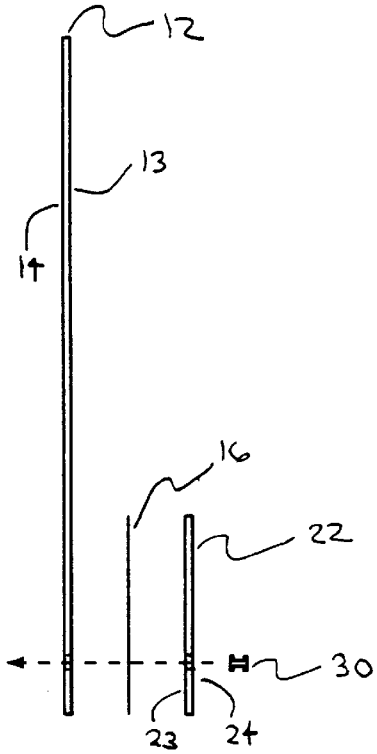
FIG. 4
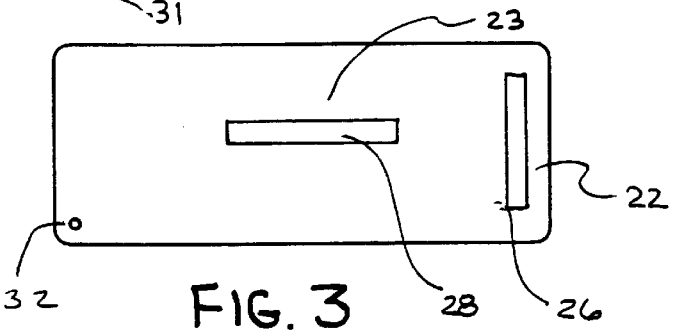
FIG. 3

MEMORABILIA DEVICE WITH TICKET DISPLAY

RELATED APPLICATIONS

This application claims the benefit of U.S. Provisional Application No. 60/167,370, filed Nov. 30, 1999.

AREA OF THE INVENTION

The present invention relates to a memorabilia display device and more particularly to a ticket or ticket stub display device capable of having other information or indicia printed or displayed thereon in addition to the ticket or ticket stub.

BACKGROUND OF THE INVENTION

Patrons of various events, such as concerts, sporting events, fairs, plays, theaters, entertainment events, and the like, often desire to retain the ticket or ticket stub as a souvenir or memento of the event. Furthermore, patrons of such events often desire a displayable souvenir bearing various indicia relating to the specific event attended by the patron, such as a sports team logo, a band logo, an illustration or picture of an athlete, or the like.

The merchandising of collectable memorabilia and related products at entertainment events has developed into a sizable and profitable business. Various sporting events can sometimes generate attendance numbers over one hundred thousand. The large number of patrons that attend these various events provides a sizable target audience for advertising and merchandising efforts.

Accordingly, it is an object of the present invention to provide a ticket or ticket stub display device that is capable of displaying and protecting a ticket or ticket stub from an event.

It is also an object of the present invention to provide a ticket or ticket stub display device that is a displayable souvenir or keepsake.

It is a further object of the present invention to provide a ticket or ticket stub display device having various indicia related to the event printed or displayed thereon.

It is yet another object of the present invention to provide a ticket or ticket stub display device having various advertising indicia printed or displayed thereon.

SUMMARY OF THE INVENTION

The present invention is a ticket display and memorabilia device comprising a main card having an opening therein. The opening is covered with a thin transparent sheet to form a window within the main card. A display card member is pivotably connected to the main card by a mechanical fastener such as a rivet, grommet, mechanical fastener, or the like. The display card member is generally positionable under the window of the main card. The display card member provides a flat surface upon which a ticket, ticket stub, or other generally flat keepsake can be mounted. The display card member can be pivoted with respect to the main card so that the flat surface can be accessed and the ticket mounted thereon. The display card member can then be pivoted back to its original position so that the ticket can be displayed through the opening of the main card. In an embodiment of the invention, a portion of the display card member can be secured to the back of the main card (to prevent pivoting of the display card in relation to the main card) by a provided adhesive strip, mechanical fastener, or the like. In accordance with an embodiment of the invention, various indicia relating to a specific event for which the ticket was purchased can be printed on the main card thereby enhancing the display of the ticket.

BRIEF DESCRIPTION OF THE DRAWINGS

FIG. 2 is a top plan view of a main card of the display device having an aperture therein and a thin transparent sheet attached to the main card over the aperture.

FIG. 3 is a top plan view of a display card portion of the display device having adhesive strips on a front surface.

FIG. 4 is an elevational side assembly view of the memorabilia ticket display device.

DETAILED DESCRIPTION OF THE INVENTION

Figure 1:
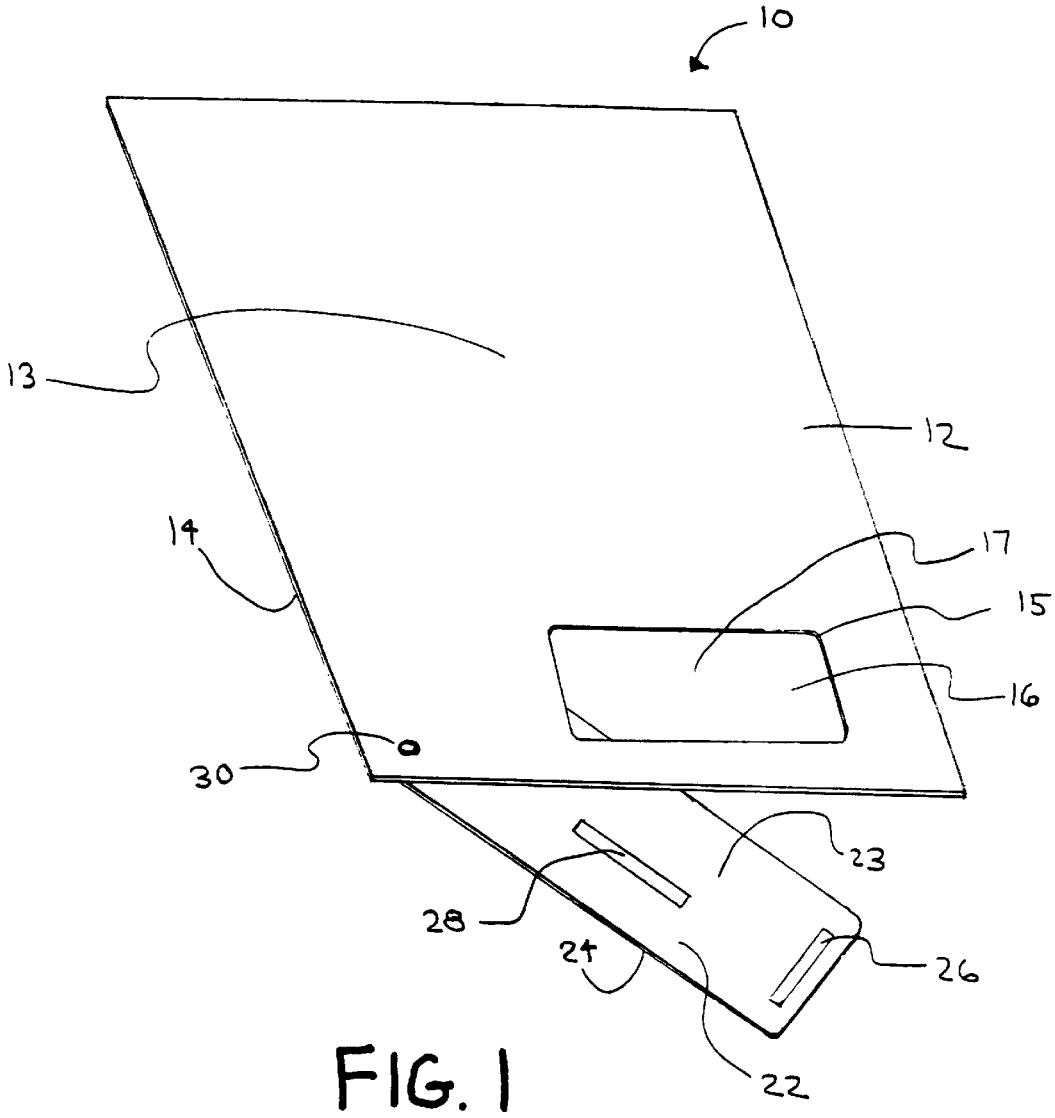
FIG. 1 is a perspective view of a memorabilia ticket display device.

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

FIG. 1 shows a ticket display device 10 that includes a generally flat main card 12 having a front surface 13 and a back surface 14. An opening such as aperture 15 is provided within the main card 12. A thin transparent sheet 16 is positioned to cover the aperture 15 and is affixed to the back surface 14 of the main card 12, thereby creating a display window 17, as shown in FIG. 2. It is noted that in alternative embodiments the display window is at any edge(s) of the main card 12 and is bounded only partially by the material of the main card 12.

The ticket display device 10 also includes generally flat display card member 22 having a front display surface 23 and a back surface 24, as shown in FIG. 3. The display card member 22 is provided, by way of example, with adhesive strips 26 and 28 on the front display surface 23. The display card member 22 is pivotably connected to the main card 12 by a mechanical fastener such as, by way of example, a grommet 30 that is inserted at a hole 31 in the main card 12 and a hole 32 in the display card member 22. Other mechanical fasteners that allow pivotable attachment can also be used, such as a rivet, pin, mechanical snap, or the like. The display card member 22 and mechanical fastener are positioned with respect to the main card 12 such that the front surface 23 of the display card member 22 is visible through the display window 17 of the main card 12 when the display card member 22 is pivoted and positioned under the main card 12, as shown in FIG. 4. The adhesive strip 26 is positioned, by way of example, on the front display surface 23 of the display card member 22 so that it can engage the back surface 14 of the main card 12 adjacent to the display window 17. Alternatively, the adhesive strip 26 is positioned to engage the transparent sheet 16. In yet another embodiment, the adhesive strip 26 is mounted upon the back surface 14 of the main card 12 or the back surface of the transparent sheet 16 facing the display card member 22.

To attach the ticket or ticket stub to the ticket display device 10, the display card member 22 is pivoted with respect to the main card 12 so that the front display surface 23 can be accessed and the ticket mounted thereon, as shown in FIG. 1. The adhesive strip 28 has a protective liner that is removed to expose the adhesive of adhesive strip 28. The ticket is then placed on the exposed adhesive of adhesive strip 28, thereby affixing the ticket to the front display surface 23 of the display card member 22. The adhesive strip 26 also has a protective liner that is removed to expose the adhesive strip 26 on the front display surface 23 of the display card member 22. In the illustrative embodiment, the display card member 22 is then pivoted back to its original position under the display window 17 of the main card 12 taking care not to allow the adhesive of adhesive strip 26 to touch the back surface 14 of the main card 12 until the display card member 22 is in its original position. When in its original position, pressure is applied to the display card member 22 and the main card 12 in the area of the adhesive of adhesive strip 26 in order to secure the display card member 22 to the back surface 14 of the main card 12, thereby securing the ticket for display through the display window 17.

In the illustrative embodiment, the main card 12 and the display card member 22 are made of a generally rigid cardboard stock but can also be made of other material, such as a paper laminate or plastic. The thin transparent sheet 16 of the display window 17 is, by way of example, typically made of MYLAR, but can also be made of any transparent plastic polymer film or sheet. In accordance with yet another embodiment of the invention, the transparent window is formed by a plastic laminate affixed to, either a portion or all of, the front surface 13 or back surface 14 of the main card 12.

Various indicia and other information, such as team logos, pictures, advertising, statistics, and the like, can be printed on the front surface 13 and the back surface 14 of the main card 12 and also the back surface 24 of the display card member 22. The printed indicia, for example, relates to a specific event for which the ticket was issued.

While specific embodiments of the present invention have been shown here for the purposes of explaining preferred and alternate embodiments of the invention, it is to be understood that the appended claims have a wide range of equivalents and a broader scope than the embodiments disclosed.

What is claimed is:

1. A keepsake display/memorabilia device comprising:

a main card including an opening covered by a transparent sheet;

a display card pivotably connected to the main card by a mechanical fastener, and including a surface to which a flat keepsake is mountable;

wherein the mechanical fastener is a grommet.

2. The keepsake display/memorabilia device of claim 1 wherein the opening is an aperture bound on all sides by the main card.

3. The keepsake display/memorabilia device of claim 1 wherein the transparent sheet is substantially smaller in dimension than the main card, and wherein the transparent sheet is affixed to the main card along edges of the main card adjacent to the opening.

4. The keepsake display/memorabilia device of claim 1 wherein a first adhesive material patch for holding a mounted flat keepsake resides on a first portion of the surface to which a flat keepsake is mountable.

5. The keepsake display/memorabilia device of claim 1 further comprising a holding mechanism for holding the display card in a fixed, non-pivoting, relationship to the main card.

6. The keepsake display/memorabilia device of claim 5 wherein the holding mechanism comprises a second adhesive material patch.

7. The keepsake display/memorabilia device of claim 6 wherein the second adhesive material patch resides on a second portion of a surface of the display card facing the main card.

8. The keepsake display/memorabilia device of claim 1 wherein the main card includes graphic indicia for subject-matter to which the keepsake corresponds.

9. The keepsake display/memorabilia device of claim 8 wherein the main card further comprises advertisement indicia.

10. A ticket display device comprising:

a main card including an opening covered by a transparent sheet;

a display card pivotably connected to the main card by a mechanical fastener, and including a surface to which a ticket is mountable;

wherein the mechanical fastener is a grommet.

11. The ticket display device of claim 10 wherein the opening is an aperture bound on all sides by the main card.

12. The ticket display device of claim 10 wherein the transparent sheet is substantially smaller in dimension than the main card, and wherein the transparent sheet is affixed to the main card along edges of the main card adjacent to the opening.

13. The ticket display device of claim 10 wherein a first adhesive material patch for holding a mounted ticket resides on a first portion of the surface to which a ticket is mountable.

14. The ticket display device of claim 10 further comprising a holding mechanism for holding the display card in a fixed, non-pivoting, relationship to the main card.

15. The ticket display device of claim 14 wherein the holding mechanism comprises a second adhesive material patch.

16. The ticket display device of claim 15 wherein the second adhesive material patch resides on a second portion of a surface of the display card facing the main card.

17. The ticket display device of claim 10 wherein the main card includes graphic indicia for an event to which the keepsake corresponds.

18. The ticket display device of claim 17 wherein the main card further comprises advertisement indicia.

* * * * *